US007966668B2

(12) United States Patent
Bay

(10) Patent No.: US 7,966,668 B2
(45) Date of Patent: Jun. 28, 2011

(54) VENTILATED GARMENT

(75) Inventor: Marc A. Bay, Farmington, MI (US)

(73) Assignee: Sullivans, Inc., Hanson, MA (US)

( * ) Notice: Subject to any disclaimer, the term of this patent is extended or adjusted under 35 U.S.C. 154(b) by 595 days.

(21) Appl. No.: 11/504,522

(22) Filed: Aug. 15, 2006

(65) Prior Publication Data

US 2008/0040832 A1 Feb. 21, 2008

(51) Int. Cl.
*A41D 1/00* (2006.01)

(52) U.S. Cl. ..... 2/93; 2/DIG. 1

(58) Field of Classification Search ..... 2/DIG. 1, 2/114, 93, 69, 85, 97
See application file for complete search history.

(56) References Cited

U.S. PATENT DOCUMENTS

| | | | |
|---|---|---|---|
| 317,711 | A | 5/1885 | Brinkmann |
| 367,921 | A | 8/1887 | Norton |
| 375,504 | A | 12/1887 | Norton |
| 385,306 | A | 6/1888 | Helwitz |
| 1,015,231 | A | 1/1912 | Jacobs |
| 1,121,515 | A | 12/1914 | Lipman |
| 1,250,004 | A | 12/1917 | Philip |
| 1,360,390 | A | 11/1920 | Gilfillan |
| 1,647,656 | A | 11/1927 | Olsen |
| 1,648,282 | A | 11/1927 | Schneider |
| 1,679,102 | A | 7/1928 | Thompson |
| 1,693,464 | A | 11/1928 | Quantz |
| 1,782,000 | A | 4/1929 | Collins |
| 1,714,491 | A | 5/1929 | Burr |
| 1,799,572 | A | 4/1931 | Sweeney |
| 1,971,622 | A | 8/1934 | Quackenbush |
| 1,973,421 | A | 9/1934 | Wallace |
| 2,010,434 | A | 8/1935 | Langrock |
| 2,079,980 | A | 8/1935 | Anders |
| 2,073,711 | A | 3/1937 | Robinsohn |
| 2,084,173 | A | 6/1937 | Wexler |
| 2,114,514 | A | 4/1938 | York |
| 2,186,918 | A | 9/1938 | Wolf |
| D115,983 | S | 8/1939 | Bailey |
| D119,122 | S | 2/1940 | Bauer |
| 2,259,560 | A | 10/1941 | Glidden |
| 2,391,535 | A | 12/1945 | Zelano |
| 2,458,004 | A | 1/1949 | Kerr |
| 2,469,700 | A | 5/1949 | Petrucelli |
| D160,800 | S | 11/1950 | Mandelbaum |
| 2,585,840 | A | 2/1952 | Reynolds |
| 2,644,946 | A | 7/1953 | Menz et al. |
| 2,700,769 | A | 2/1955 | Polchinski |

(Continued)

FOREIGN PATENT DOCUMENTS

| | | |
|---|---|---|
| CA | 2 344 726 | 10/2002 |

(Continued)

OTHER PUBLICATIONS

2001 Kushitani Riding Equipment Collection, 2001,9 pages.

(Continued)

*Primary Examiner* — Alissa L Hoey
(74) *Attorney, Agent, or Firm* — Cesari and McKenna, LLP

(57) ABSTRACT

A ventilated garment is provided. Another aspect of the present invention employs a jacket having a body portion with sleeves and a torso, and a removable shell portion having a sleeve and a laterally elongated chest and/or back segment. A further aspect of the present invention provides aesthetically pleasing interfaces between air permeable and air blocking segments.

12 Claims, 13 Drawing Sheets

U.S. PATENT DOCUMENTS

| | | | | |
|---|---|---|---|---|
| 2,713,168 | A | | 7/1955 | Bagnato |
| 2,715,226 | A | | 8/1955 | Weiner |
| 2,722,694 | A | | 11/1955 | Bryant |
| 2,989,764 | A | | 6/1961 | Bukspan |
| 3,045,243 | A | | 7/1962 | Lash et al. |
| 3,086,215 | A | | 4/1963 | Di Paola |
| 3,153,793 | A | | 10/1964 | Lepore |
| 3,213,465 | A | | 10/1965 | Ludwikowski |
| 3,389,407 | A | | 6/1968 | Morrison |
| 3,536,083 | A | | 10/1970 | Reynolds |
| D220,822 | S | | 5/1971 | DeWan |
| 3,638,241 | A | | 2/1972 | Holmes |
| 3,691,564 | A | | 9/1972 | La Marre et al. |
| 3,706,102 | A | | 12/1972 | Grenier |
| 3,761,962 | A | | 10/1973 | Myers |
| 3,771,169 | A | | 11/1973 | Edmund |
| 3,921,224 | A | | 11/1975 | Ingram, III |
| 3,924,273 | A | | 12/1975 | Donovan |
| 3,969,772 | A | | 7/1976 | Pravaz |
| D248,896 | S | | 8/1978 | Hasday et al. |
| 4,122,553 | A | | 10/1978 | Pitkanen |
| 4,170,793 | A | | 10/1979 | O'Brein |
| 4,185,327 | A | | 1/1980 | Markve |
| 4,195,362 | A | | 4/1980 | Rolando |
| D261,071 | S | | 10/1981 | Rolando |
| 4,320,538 | A | * | 3/1982 | Saft ..... 2/102 |
| 4,390,996 | A | | 7/1983 | Read |
| 4,397,043 | A | | 8/1983 | Croteau |
| 4,408,356 | A | | 10/1983 | Abrams |
| 4,513,451 | A | | 4/1985 | Brown |
| 4,554,682 | A | | 11/1985 | Hillquist |
| 4,563,777 | A | | 1/1986 | Park |
| 4,569,089 | A | | 2/1986 | Nesse |
| 4,608,715 | A | | 9/1986 | Miller et al. |
| 4,665,563 | A | | 5/1987 | Harvey |
| 4,722,099 | A | | 2/1988 | Kratz |
| 4,783,858 | A | | 11/1988 | Chevalier |
| D306,511 | S | | 3/1990 | Jones |
| D308,435 | S | | 6/1990 | Kushitani |
| D310,286 | S | | 9/1990 | Kushitani |
| 4,996,723 | A | | 3/1991 | Huhn et al. |
| 5,033,118 | A | | 7/1991 | Lincoln |
| 5,097,535 | A | | 3/1992 | Dye et al. |
| 5,105,477 | A | | 4/1992 | Golde |
| 5,105,478 | A | | 4/1992 | Pye |
| 5,115,516 | A | | 5/1992 | Golde |
| D332,342 | S | | 1/1993 | Dye et al. |
| 5,201,075 | A | | 4/1993 | Svetich |
| 5,325,537 | A | | 7/1994 | Marion |
| 5,398,343 | A | | 3/1995 | Kuracina |
| 5,507,042 | A | | 4/1996 | van der Slessen |
| 5,555,562 | A | | 9/1996 | Holt et al. |
| 5,592,691 | A | | 1/1997 | Ronald |
| 5,603,646 | A | | 2/1997 | Tobias |
| 5,687,423 | A | | 11/1997 | Ross |
| D387,190 | S | | 12/1997 | Garcia |
| 5,704,064 | A | | 1/1998 | van der Sleesen |
| 5,718,000 | A | | 2/1998 | Ost et al. |
| 5,752,277 | A | | 5/1998 | van der Sleesen |
| 5,774,891 | A | | 7/1998 | Boyer |
| 5,845,336 | A | | 12/1998 | Golde |
| 5,850,634 | A | | 12/1998 | Toombs |
| 5,884,332 | A | | 3/1999 | Snedeker |
| 5,924,135 | A | | 7/1999 | Worth |
| 6,018,819 | A | | 2/2000 | King et al. |
| D426,050 | S | | 6/2000 | Bowen |
| 6,070,274 | A | | 6/2000 | van der Sleesen |
| 6,085,353 | A | | 7/2000 | van der Sleesen |
| 6,119,270 | A | | 9/2000 | Chou |
| 6,163,883 | A | | 12/2000 | Hong |
| D437,673 | S | | 2/2001 | DesJardins et al. |
| D438,692 | S | | 3/2001 | Digby |
| 6,260,196 | B1 | | 7/2001 | van der Sleesen |
| 6,263,509 | B1 | | 7/2001 | Bowen |
| 6,263,510 | B1 | | 7/2001 | Bay et al. |
| 6,263,511 | B1 | | 7/2001 | Moretti |
| 6,295,654 | B1 | | 10/2001 | Farrell |
| 6,298,485 | B1 | | 10/2001 | Heller |
| 6,339,843 | B1 | | 1/2002 | Grilliot et al. |
| 6,339,845 | B1 | | 1/2002 | Burns et al. |
| 6,360,371 | B1 | | 3/2002 | Davey |
| 6,405,377 | B1 | | 6/2002 | Davis |
| 6,421,834 | B2 | | 7/2002 | Kester |
| 6,460,185 | B1 | | 10/2002 | Hardy |
| 6,490,734 | B2 | | 12/2002 | Blauer et al. |
| 6,499,141 | B1 | | 12/2002 | Egnew |
| D479,901 | S | | 9/2003 | Brownlee |
| D479,902 | S | | 9/2003 | Brown |
| 6,684,408 | B2 | | 2/2004 | Rindle et al. |
| 6,792,621 | B2 | | 9/2004 | Braun |
| 6,802,082 | B2 | | 10/2004 | Watley |
| D498,037 | S | | 11/2004 | Bay |
| 6,851,128 | B1 | | 2/2005 | Parrotte |
| 6,854,130 | B2 | | 2/2005 | van der Sleesen |
| 6,868,557 | B1 | | 3/2005 | van der Sleesen |
| 7,028,342 | B1 | * | 4/2006 | Nordstrom et al. ..... 2/119 |
| 7,111,328 | B2 | * | 9/2006 | Bay ..... 2/86 |
| 7,284,282 | B2 | * | 10/2007 | Bay ..... 2/93 |
| 7,343,629 | B2 | * | 3/2008 | Hunt ..... 2/93 |
| 7,412,728 | B2 | * | 8/2008 | Alesina et al. ..... 2/93 |
| 2003/0013368 | A1 | | 1/2003 | Braun |
| 2003/0033656 | A1 | | 2/2003 | Jaeger |
| 2003/0079271 | A1 | * | 5/2003 | Gillen et al. ..... 2/102 |
| 2003/0172435 | A1 | | 9/2003 | Rindle et al. |
| 2004/0055069 | A1 | | 3/2004 | Fayle et al. |
| 2004/0158910 | A1 | * | 8/2004 | Bay ..... 2/69 |
| 2004/0199976 | A1 | * | 10/2004 | Hunt ..... 2/93 |
| 2005/0015843 | A1 | | 1/2005 | Roux et al. |
| 2005/0235392 | A1 | | 10/2005 | Bay |
| 2006/0041990 | A1 | * | 3/2006 | Alesina et al. ..... 2/93 |

FOREIGN PATENT DOCUMENTS

| | | | |
|---|---|---|---|
| EP | 0 000 095 | | 12/1978 |
| EP | 0 034 518 | | 1/1981 |
| EP | 0 071 226 | | 2/1983 |
| EP | 0 643 929 | | 3/1985 |
| EP | 0 161 564 | | 11/1985 |
| EP | 0 412 450 | | 2/1991 |
| EP | 0 819 389 | | 1/1998 |
| EP | 0 870 745 | | 10/1998 |
| EP | 0 913 170 | | 6/1999 |
| EP | 0 974 277 | | 1/2000 |
| EP | 1 329 167 | A2 | 7/2003 |
| FR | 2 546 759 | | 12/1984 |
| FR | 2 783 138 | | 3/2000 |
| GB | 461247 | | 2/1937 |
| GB | 2 104 770 | A | 3/1983 |
| JP | 59-4722 | | 1/1984 |
| JP | 8-284009 | | 10/1996 |
| WO | WO 94/00036 | | 1/1994 |
| WO | WO 96/39056 | | 12/1996 |
| WO | WO 02/01977 | | 1/2002 |
| WO | WO 02/060287 | | 8/2002 |
| WO | WO 03/006234 | | 1/2003 |

OTHER PUBLICATIONS

Cabela's Master Catalog, Fall 1998, p. 50-51.

Red Head, Fall 1999, Specialist Catalog, p. 17.

AGV Aeromesh Textile Jacket, www.agvsport.com (2004).

Fieldsheer Mach 1, Mach 2, Sonic Air, Titanium Air, Highland Suit, Highland 2, Kiri, Manx Pro, Spiga, Thistle, XPack Tech, Cabrio, Latrak jackets; http://store.fieldsheer.com (Feb. 8, 2003).

Japanese publication with English translation entitled "Proto War-RJ" citing Kiss Racing, (believed to have been published in 2000).

Five photographs of Joe Rocket® "Bulldog" jacket (offered for sale before 2003).

"Fieldsheer Air Speed Jacket", Advertisement from Parts & Accessories, MOTORCYCLEVILLE.COM, Year 2001 Model, (published Feb. 8, 2003) 1 page.

"Joe Rocket" Catalog, Spring 2002, (published 2002), Cover page and pp. 4-5, 13, 32 and 35.

"Steve Largent Autographed Football Jersey Mesh", Advertisement from COLLECTIBLES.GOANTIQUES,COM, 1996-2003, (published Feb. 8, 2003), 1 page.

Drawing of Fieldsheer Jacket with removable torso vest (offered for sale or publicly used prior to Feb. 13, 2003), 1 page.

2000 Motorcycle—Joe Rocket brochure, back page and p. 5 ("Bulldog" jacket), published in 1999.

Jacket Design, H-D Michigan, Inc., Trademark Reg. No. 2,892,609, Reg. Date Oct. 12, 2004.

Fieldsheer Advertisement for Black Leather Collection, 3 sheets, dated Jan. 5, 2006; Fieldsheer Online.com.

* cited by examiner

VENTILATED GARMENT

BACKGROUND OF THE INVENTION

The present invention relates generally to a garment and more particularly to a ventilated garment.

Garments, such as jackets and combined pant/jacket racing suits, are commonly used by people operating motor sport vehicles such as a motorcycle, all-terrain vehicle or snowmobile. Such jackets and suits commonly employ an outer shell covering the complete torso and arms of the person, and an inner insulative liner which can be removed for warm weather use. For example, reference should be made to U.S. Pat. No. 6,263,510 entitled "Ventilating Garment" which issued to Bay et al. on Jul. 24, 2001. This patent is incorporated by reference herein.

Another conventional motorcycle jacket employed a leather torso have perforations on the shoulder, chest, back and lower torso regions. It also had solid and non-perforated sleeves sewn to the torso. A non-perforated and wind resistant vest was optionally provided to externally cover the perforated torso of the jacket but could be removed to allow air entry through the torso holes. A first vertical zipper was provided for the front of the jacket torso and a second front vertical zipper was provided for the vest. This conventional jacket, however, suffered from the disadvantages of allowing undesired air flow through the sleeve-to-torso openings between the vest and jacket interface, ultraviolet light penetrating through the perforated shoulders of the torso when the vest was removed thereby leading to sunburn of the wearer, crash protection not being provided at the shoulders of the jacket when the vest was removed, and the two-piece appearance of the vest and jacket being unattractive.

U.S. Patent Publication No. 2005/0235392 entitled "Hybrid Ventilated Garment," which was invented by M. Bay and is incorporated by reference herein, discloses a significant improvement in garment venting. Nevertheless, there is further room for improvement in venting while providing different aesthetic appearances.

SUMMARY OF THE INVENTION

In accordance with the present invention, a ventilated garment is provided. Another aspect of the present invention employs a jacket having a body portion with sleeves and a torso, and a removable shell portion having sleeve and a laterally elongated chest and/or back segment. A further aspect of the present invention provides aesthetically pleasing interfaces between air permeable and air blocking segments. In still another aspect of the present invention, an air permeable and/or perforated sleeve section is attached to an ultraviolet light blocking upper shoulder section and a dense shell is removably attachable to cover the air permeable sleeve section. In a further aspect of the present invention, a lateral shell section removably blocks air flow through an air permeable section in a generally continuous manner (except for seams, zippers and the like) along the chest, upper sleeve and upper back regions of the garment.

The present invention garment is advantageous over traditional jackets in that the present invention always provides ultraviolet light blockage along the wearer's shoulders and upper arm portions. The present invention is further advantageous by providing crash protective pads and/or body armor, at least some of which are preformed, even if an outer torso shell is removed. Moreover, the present invention is advantageous by allowing significant torso and sleeve ventilation for use in hot weather yet easily allows attachment of a wind resistant, and/or thermally insulating and/or waterproof portion to cover the underlying air permeable and/or perforated material. The present invention is also aesthetically fashionable and provides easy to use attachment systems which effectively reduce air entry holes when the ventilating material is covered. Furthermore, a lateral oriented and brightly colored stripe is presented when a differently colored, outer cover is removed, thereby achieving a variable and highly stylish appearance. Additional advantages and features of the present invention will become apparent from the following description and appended claims, taken in conjunction with the accompanying drawings.

DETAILED DESCRIPTION OF THE PREFERRED EMBODIMENTS

Figure 1:
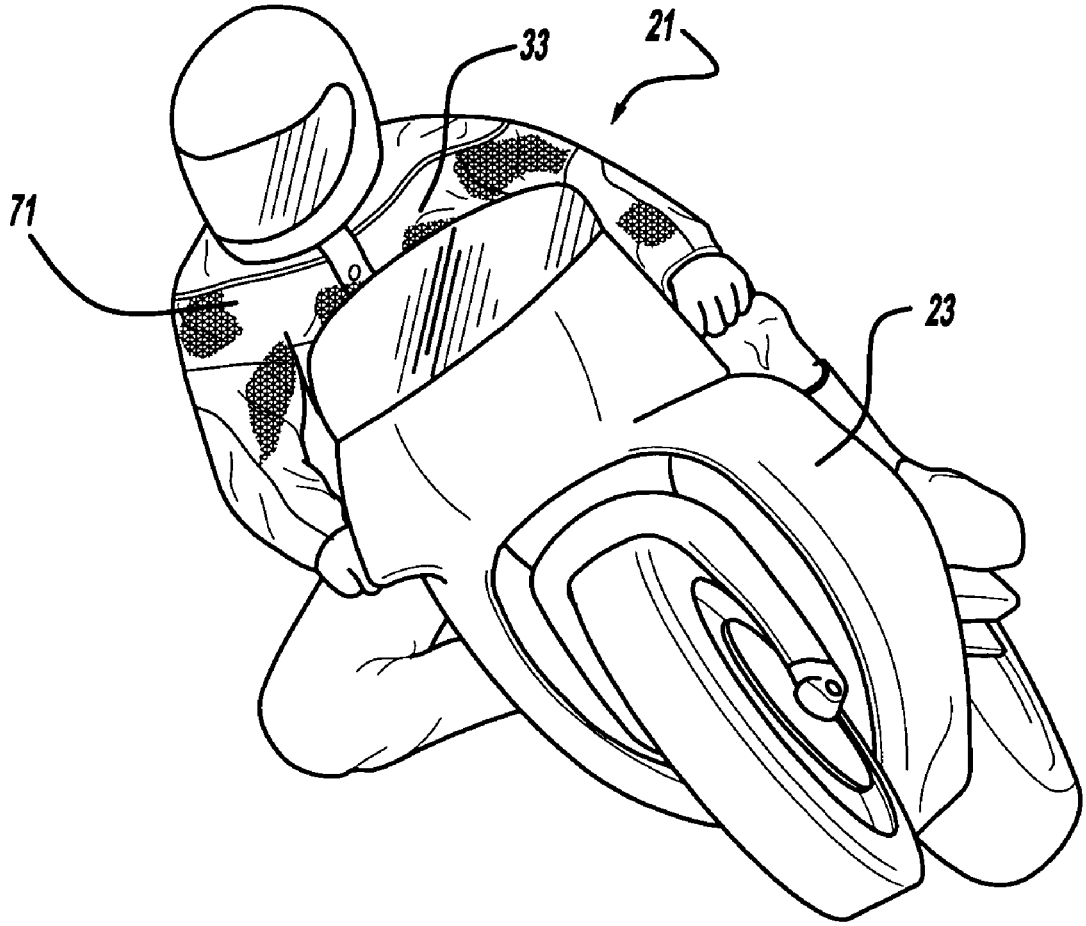
FIG. 1 is a perspective view showing a first preferred embodiment of the ventilated garment of the present invention, used by a rider on a motorcycle.

Referring to FIGS. 1-8, a first preferred embodiment of a ventilated garment, preferably a jacket 21 or a jacket portion of a combined jacket/pant racing suit, of the present invention is worn by a person riding a motorsport vehicle, such as a motorcycle 23 or other motorized vehicle such as an all-terrain vehicle or snowmobile. Jacket 21 includes two major portions, a body 25 and a shell 27, also known as a cover. Body 25 has a mesh inner liner 29, an outer wind resistant material 31 and an outer mesh material 33. Body 25 includes a torso segment 32 and permanently attached sleeve segments 34.

Crash absorbing padding, also known as body armor, is positioned as follows. A pair of preformed, convex shoulder pads 35 are internally attached within pockets internally sewn to mesh inner liner 29. These pockets are closed at their top edges by hook and loop-type fasteners, or alternately snaps, zippers, stitches or other fasteners. It is optionally envisioned in an alternate embodiment that additional preformed elbow pads are inserted into internal pockets sewn to an inside of liner 29, supplemental generally rigid polymeric shoulder pads can be internally attached to body and/or protective spine pads can be internally attached to body. A generally flat, lower back pad 39 is sewn to the inside of a waistband segment 41, also made of wind resistant material 31. The preformed pads are preferably molded from multi-layer composite, resinated foam-like materials. Some of the body armor pieces disclosed herein, which aid in cushioning the impact the motorcycle user receives during motorcycle crashes, can be readily substituted or supplement by generally rigid polymeric panels having flat or three-dimensionally curved shapes.

Shell 27 includes a left chest segment 38, a left sleeve segment 40, an upper back segment 41, a right sleeve segment 42 and a right chest segment 43. Shell 27 is made from a wind resistant textile fabric outer material 44, like material 31 of body, and a mesh liner 45 sewn thereto. Upper and lower zipper attachment systems 91 and 93, respectively, are sewn to upper and lower central edges of shell 27, and hook-and-loop attachment strips 46 are sewn to the vertical front edges. Sleeve segments 40 and 42 are generally cylindrical from an open end to an armpit area, and are permanently sewn to the chest and back segments. The entire removable shell is flexible or pliable. A fastener is located on each sleeve segment 40 and 42 of shell 27 adjacent a cuff or open end 47. Each fastener includes a fabric tab upon which is mounted a female snap attachment 49. The male snap attachment 51 protrudes from the sleeve for selective attachment with female snap attachment 49. Moreover, a cuff adjustment is disposed adjacent open end 47 of each sleeve segment 40 and 42 which corresponds to a wrist area of the user. Each cuff adjustment includes a zipper assembly 53 with a flexible piece of triangularly-shaped fabric sewn between the zipper tracks and which can be expanded when the zipper 53 is unzipped or hidden from view when zipped.

Figure 2:
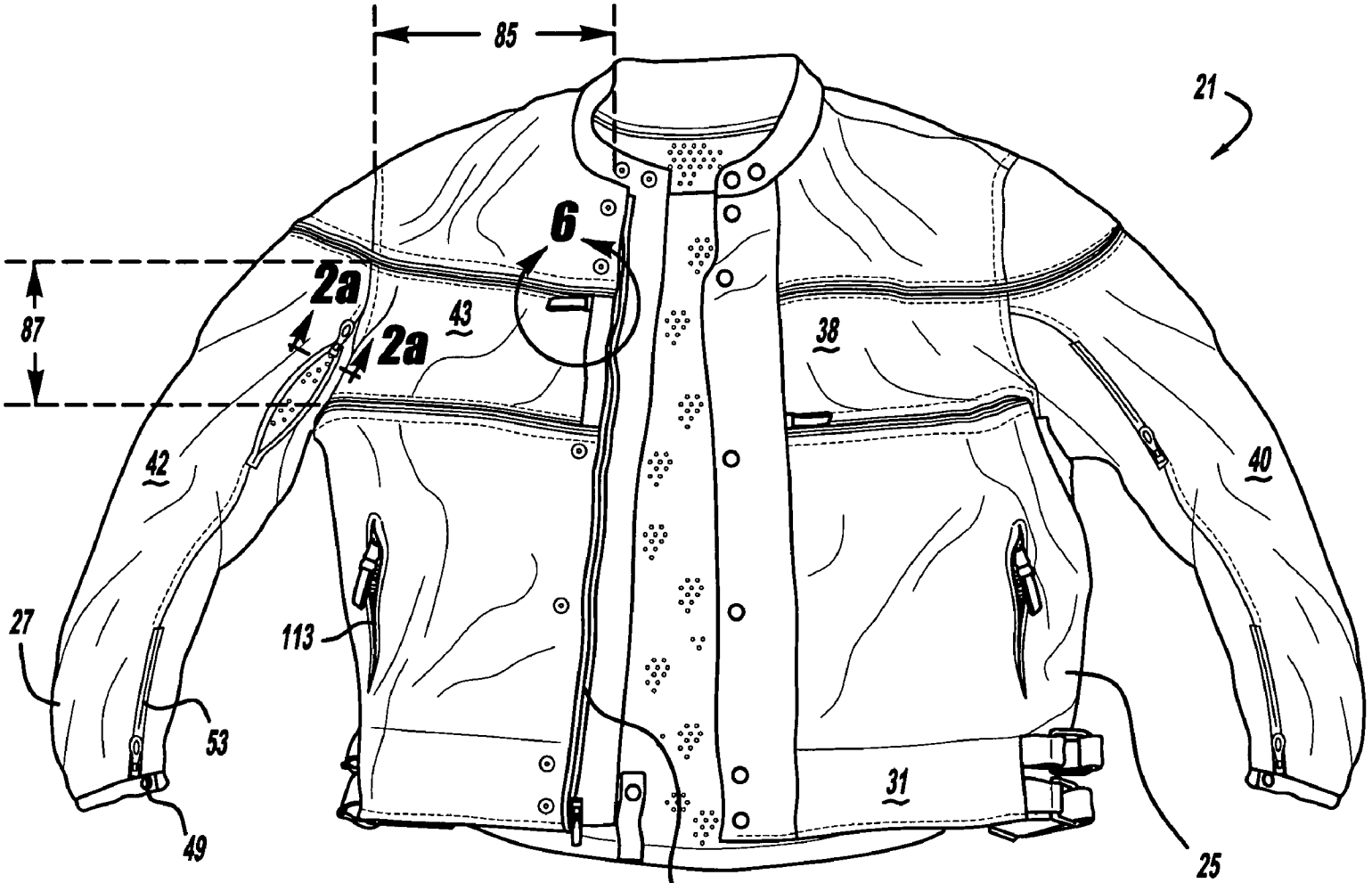
FIG. 2 is a front elevational view showing the first preferred embodiment garment, with a shell attached to a body.
Figure 2A:
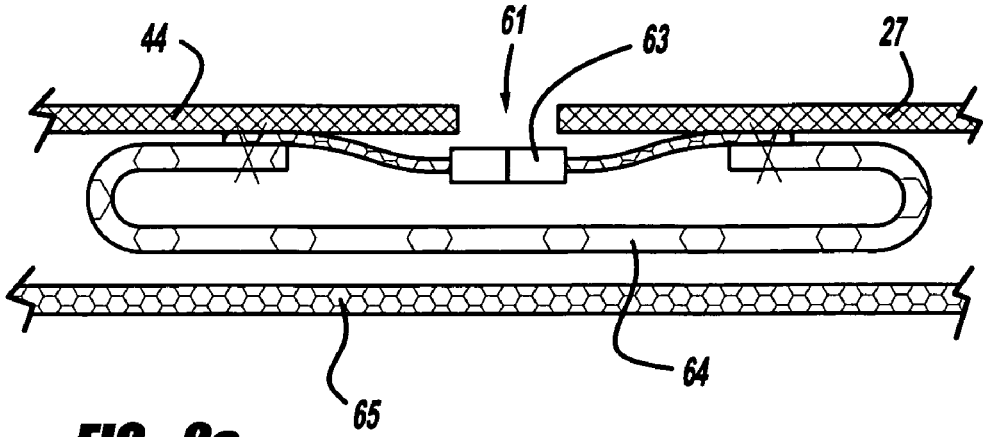
FIG. 2*a* is a cross-sectional view, taken along line 2*a*-2*a* of FIG. 2, showing the first preferred embodiment garment.

Furthermore, a sleeve air vent 61 is located on a front and upper segment of each sleeve segment 40 and 42 of shell 27, generally between the elbow and shoulder areas. This can best be observed in FIGS. 2 and 2*a*. Each air vent 61 includes a zipper 63, having mating zipper teeth and a zipper pull, which exposes an underlying perforated or mesh fabric layer 64 which then operably allows air flow therethrough. Closure of zipper 63 acts to block airflow through the corresponding sleeve air vent 61. A perforated or mesh liner material 65 is located internally behind mesh layer 64 and is sewn to at least a majority of and preferably almost all of the back side of outer material 44 as a liner.

Referring to FIGS. 3*a* and 4-8, a primary vent 71 is permanently sewn to body 25 between the shoulder area and a mid-torso area generally defined by a lateral line approximately extending between armpits 73 of jacket 21. Primary vent 71 is made from outer mesh fabric material 33 and a perforated or open weave liner 29 which are both air permeable for two-way ventilation. A front, central and vertically elongated zipper attachment system 79 is disposed on the front of body 25 and includes a pair of parallel zipper tracks with teeth and a zipper pull slide. Primary vent 71 laterally extends around the entire torso periphery and adjacent sleeve sections in a generally continuous manner, from zipper track to zipper track of central zipper system 79 but may be slightly interrupted by front piping welts, seams, zipper openings and the like sewn thereto. Mesh 33 of primary vent 71 is further located on the lower areas of each sleeve segment 40 and 42 extending from adjacent the sleeve opening/cuff 47 to armpit 73 and up to the bottom of the shoulder area. Thus, outer mesh material 33 is permanently sewn to wind resistant material 31 along the bottom edge of the shoulder area, to the upper edge of wind resistant material 31 of the mid-torso area at the front and back of body 25, and to central zipper attachment system 79. Wind resistant material 31 is additionally located in a patch-like and localized manner on the exterior of each sleeve forearm area 75.

Piping welts 77 and 81 are sewn adjacent and parallel to zipper systems 91 and 93. One or more of these welts are reflective to improve night-time visibility of the user for approaching motorists. A pair of torso air vents 83 are similarly constructed to sleeve air vents 61, however, they are generally vertically oriented (when the jacket user is standing) and located on the back and lower, torso area of the jacket above waistband segment 41.

As can best be observed in FIGS. 2-6, shell 27 serves to block wind from entering the underlying vent mesh 33 (and associated liner mesh 29) of body 21 when fully attached. The lateral right chest segment 43 of shell 27 is larger in a lateral and general horizontal direction 85 than in a longitudinally vertical direction 87 perpendicular thereto (again, as viewed when the jacket is worn by a standing user). The left chest segment 38 is similarly dimensioned and the back, upper torso segment 41 is approximately twice as laterally long. These relative dimensions are similar for the underlying mesh 33. When attached, the sleeve portions of the shell essentially cover and overlie the entire mesh 33 and forearm areas 75 of the body sleeves. Snaps attach the ends of the shell sleeves to the body sleeves. Upper and lower, laterally moveable zipper attachment systems 91 and 93 continuously secure shell 27 to body adjacent the bottom edge of the shoulder area and the upper edge of wind resistant material 31 of the mid-torso area at the front and back of body 25. Each zipper system 91 and 93 includes a pair of toothed zipper tracks and a zipper pull slide. In other words, both upper and lower zipper systems 91 and 93, respectively, extend from one side of central zipper attachment system 79, horizontally across the chest, around the exterior of the upper sleeve for the upper zipper system but only around the armpit for the lower zipper system, horizontally across the back of the upper torso, around the opposite sleeve and armpit in a similar manner, across the opposite chest, and terminating at the opposite side of central zipper attachment system 79. Hook-and-loop fastening system 46 removably couples the vertical edges of shell 27 to storm flaps 95 adjacent each side of central zipper attachment system 79 (see FIG. 6). A primary storm flap 96, with snap attachments 97, spans across central zipper system 79.

Figure 4:
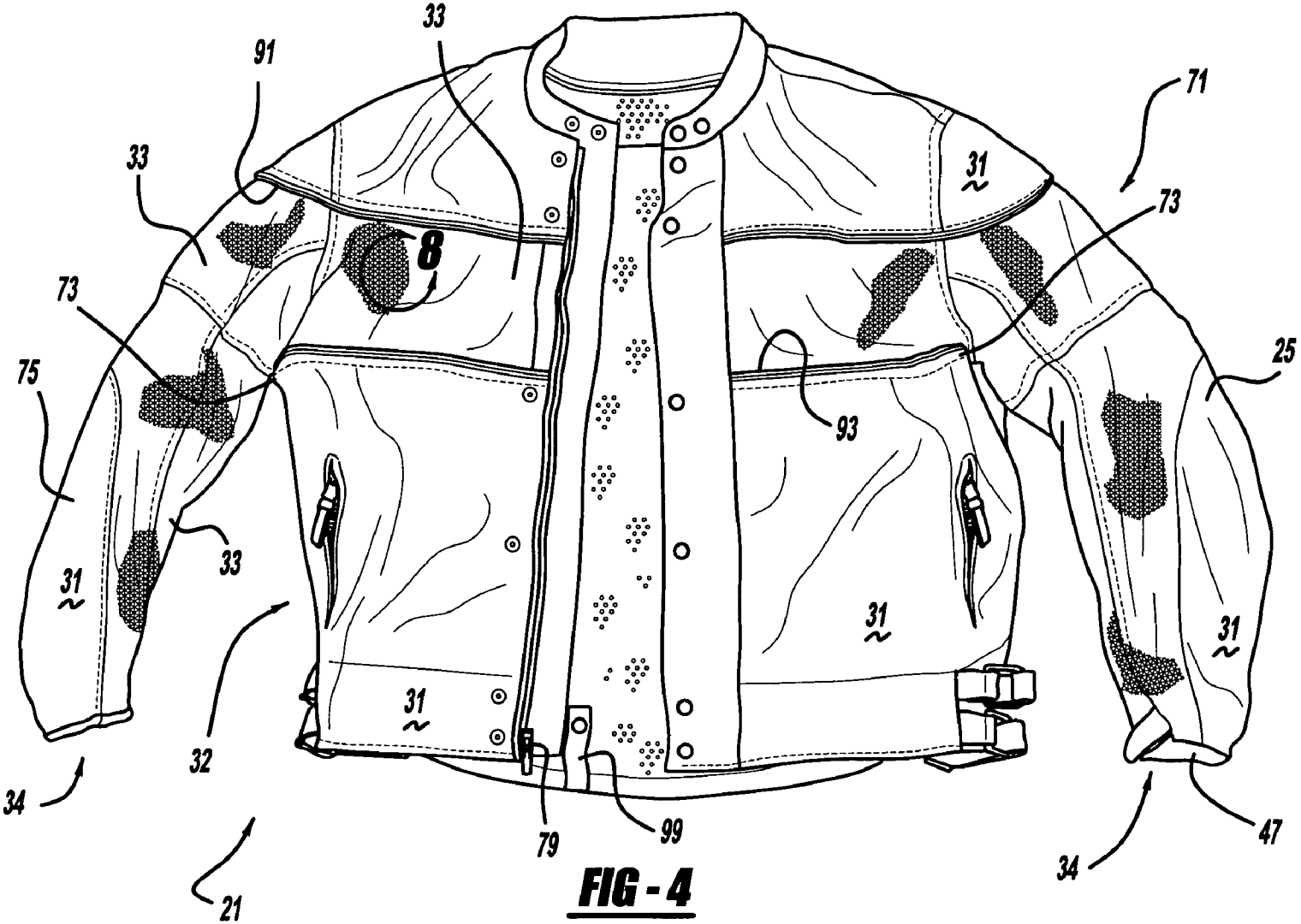
FIG. 4 is a front elevational view showing the first preferred embodiment garment, with the shell fully removed.
Figure 5:
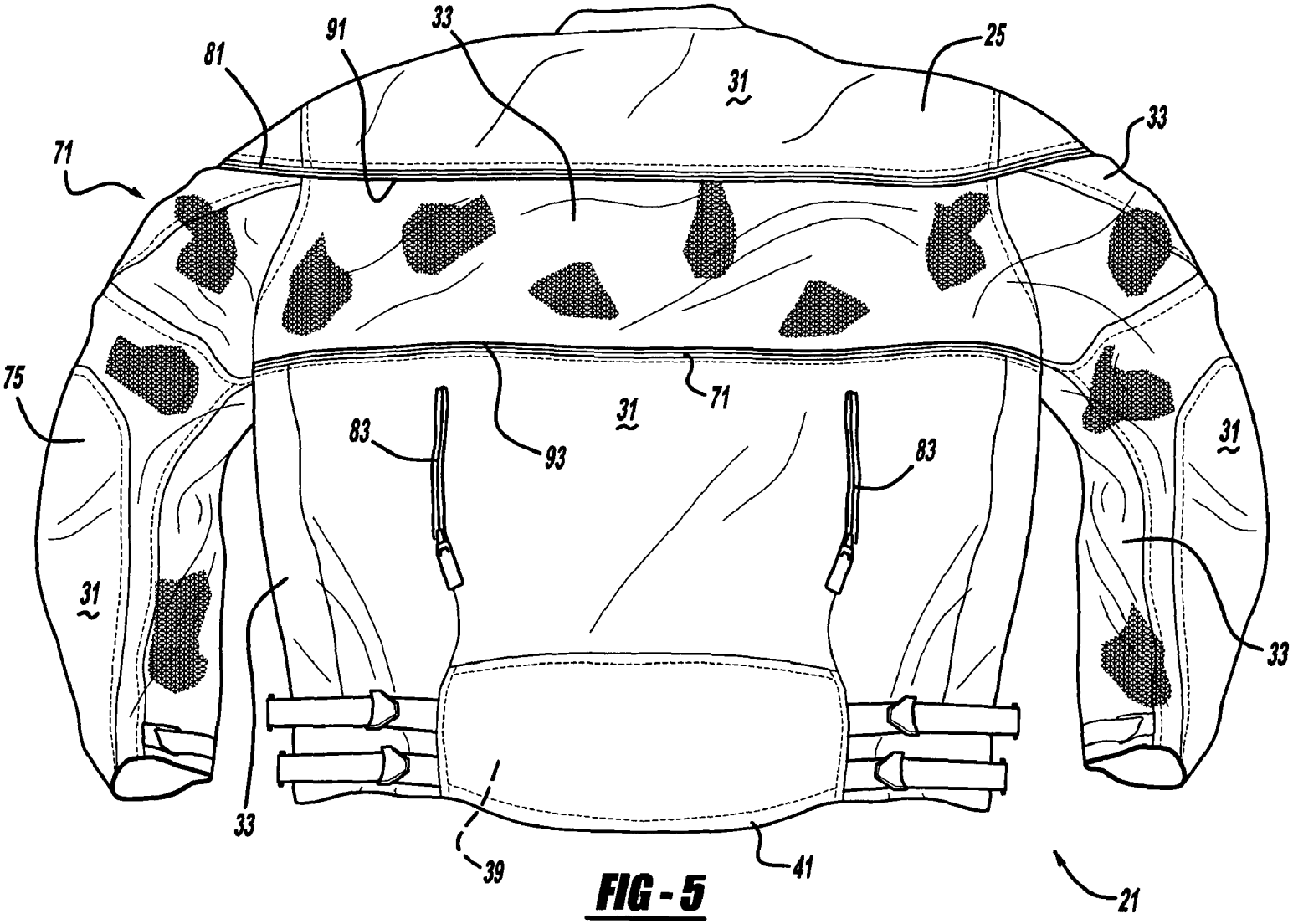
FIG. 5 is a rear elevational view showing the first preferred embodiment garment, with the shell fully removed.
Figure 6:
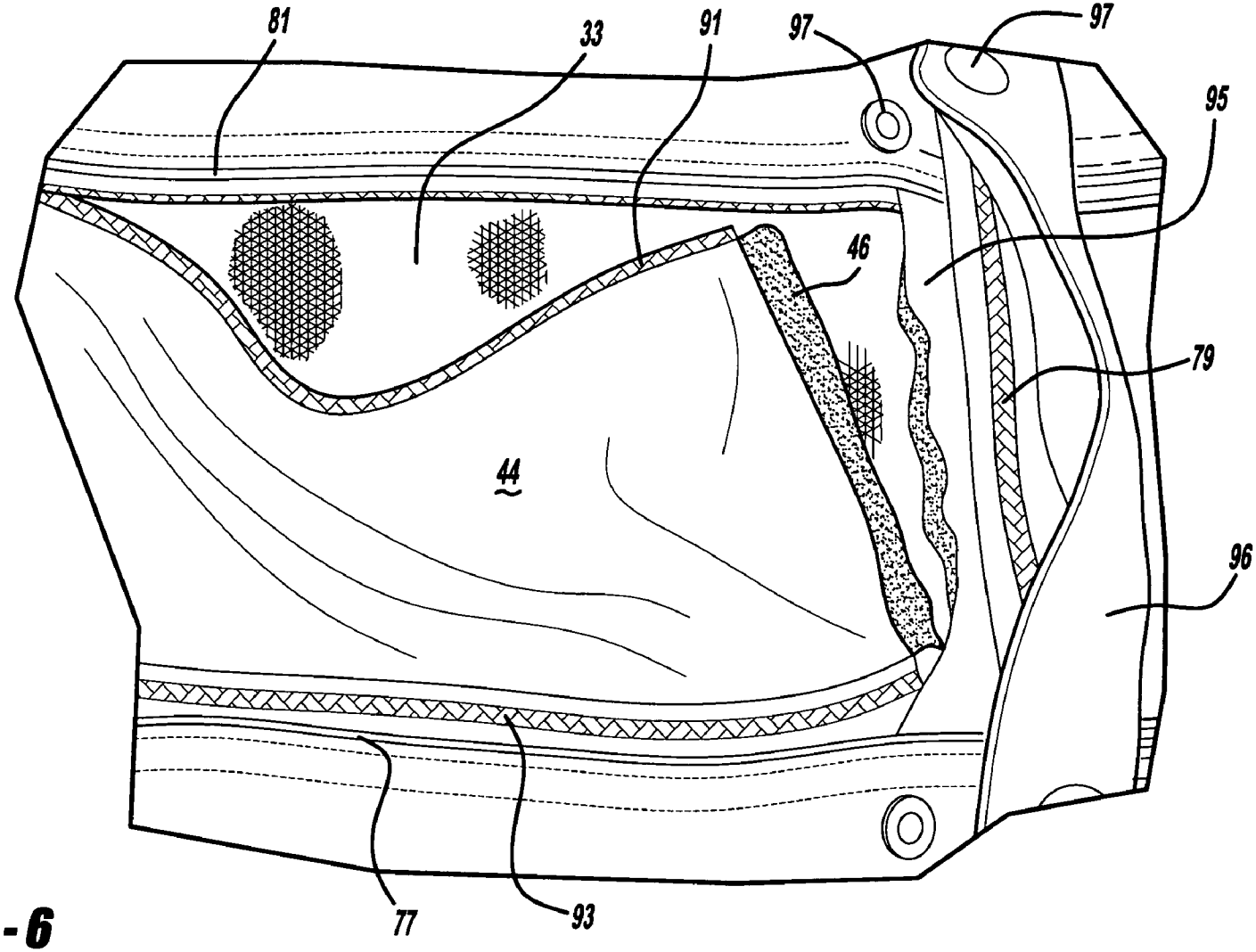
FIG. 6 is an enlarged front elevational view, taken within circle 6 of FIG. 2, showing a portion of the first preferred embodiment garment, with the shell partially removed.
Figure 7:
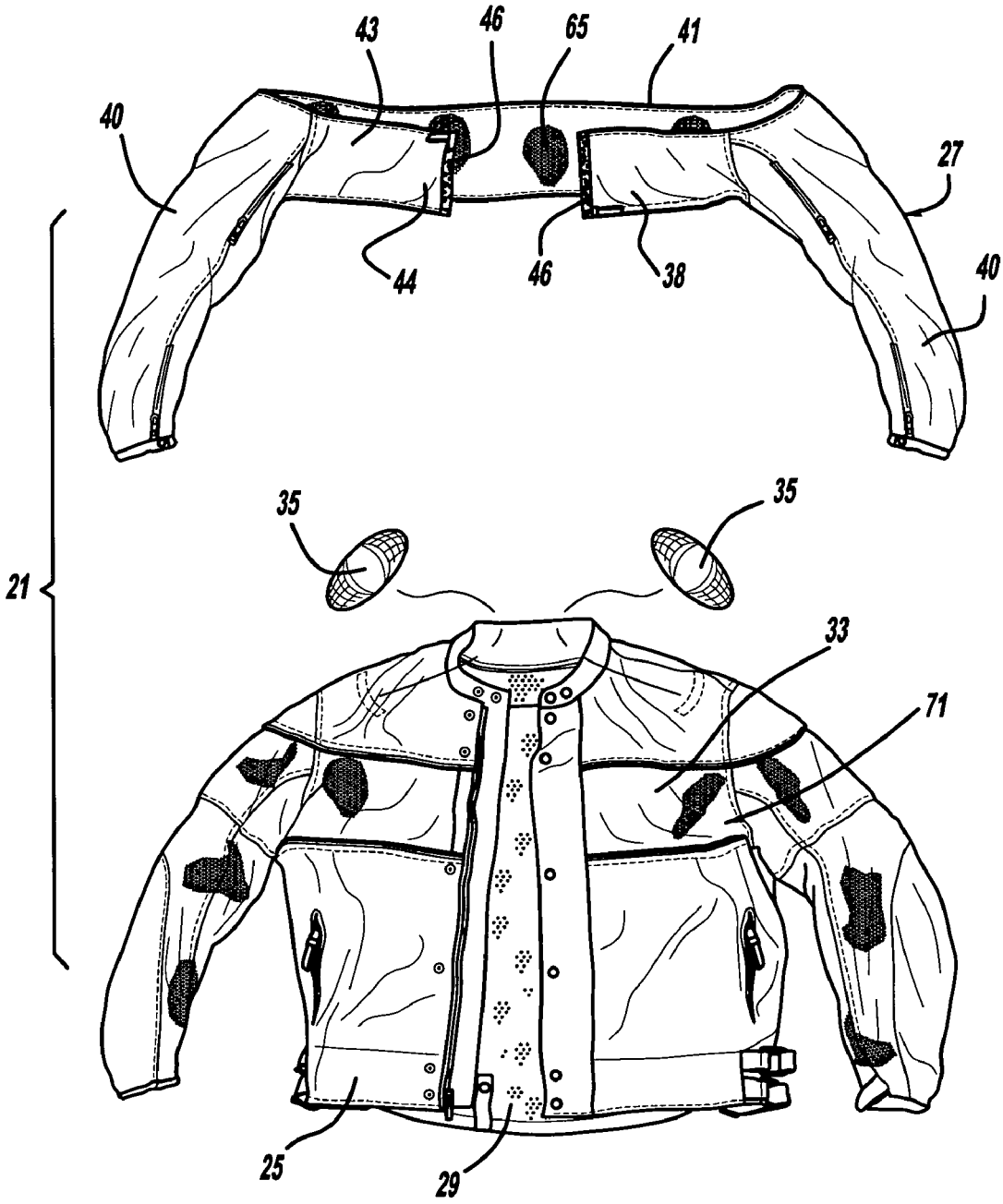
FIG. 7 is a partially exploded, front elevational view showing the first preferred embodiment garment.
Figure 8:
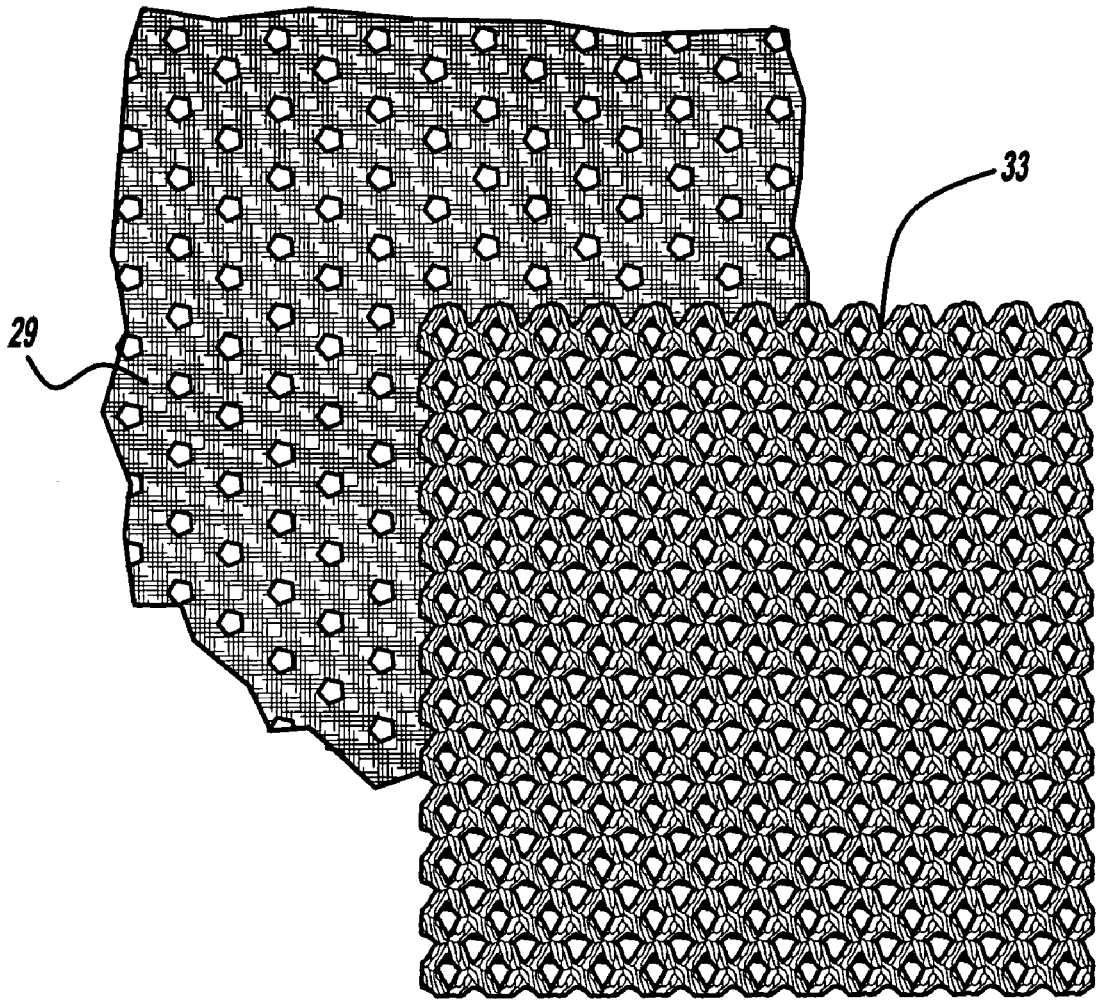
FIG. 8 is an enlarged and fragmentary view, taken within circle 8 of FIG. 4, showing the mesh air permeable material employed in the first preferred embodiment garment.
Figure 9:
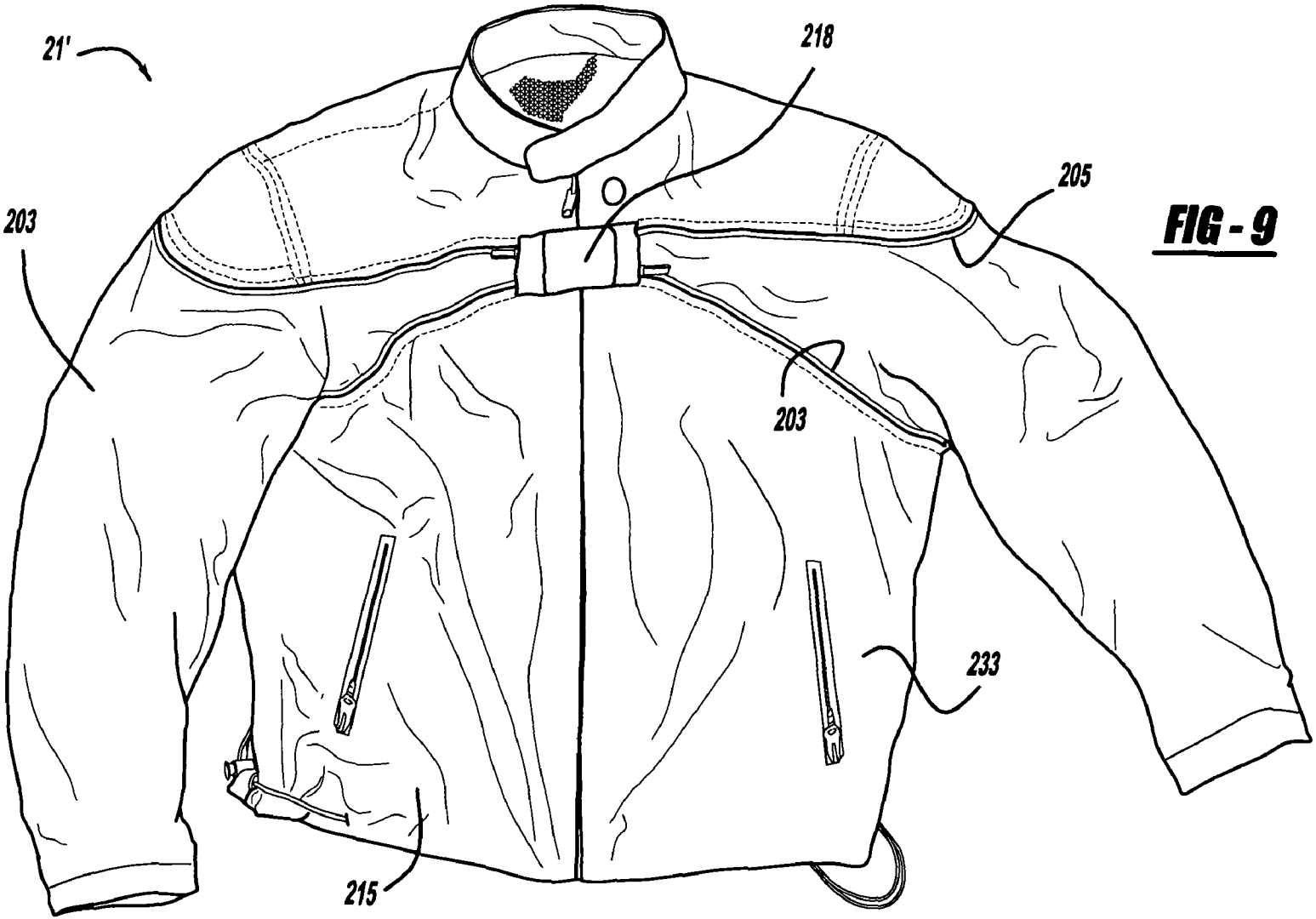
FIG. 9 is front elevational view showing a second preferred embodiment garment, with a shell attached to a body.
Figure 10:
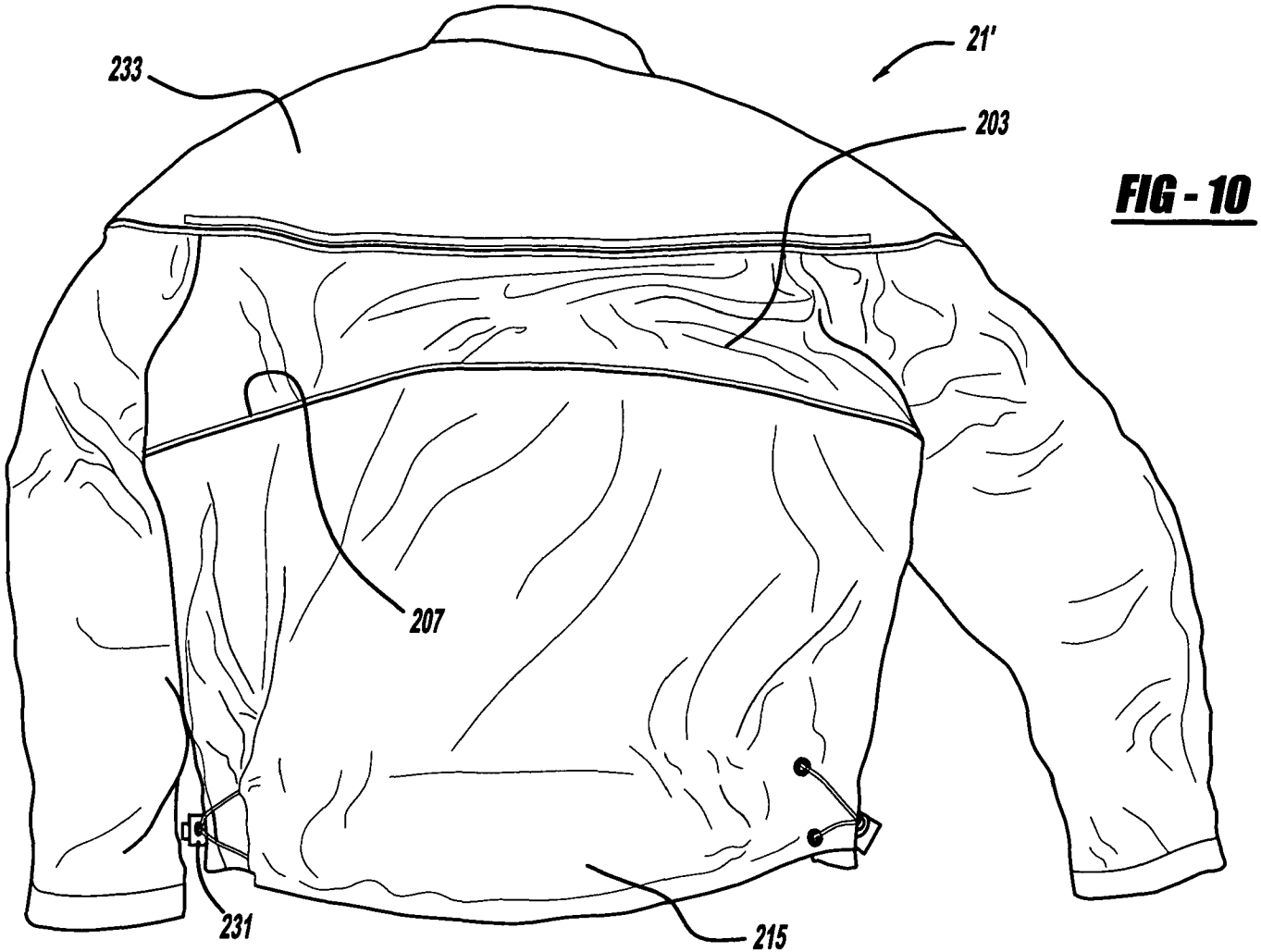
FIG. 10 is rear elevational view showing the second preferred embodiment garment, with the shell attached to a body.
Figure 11:
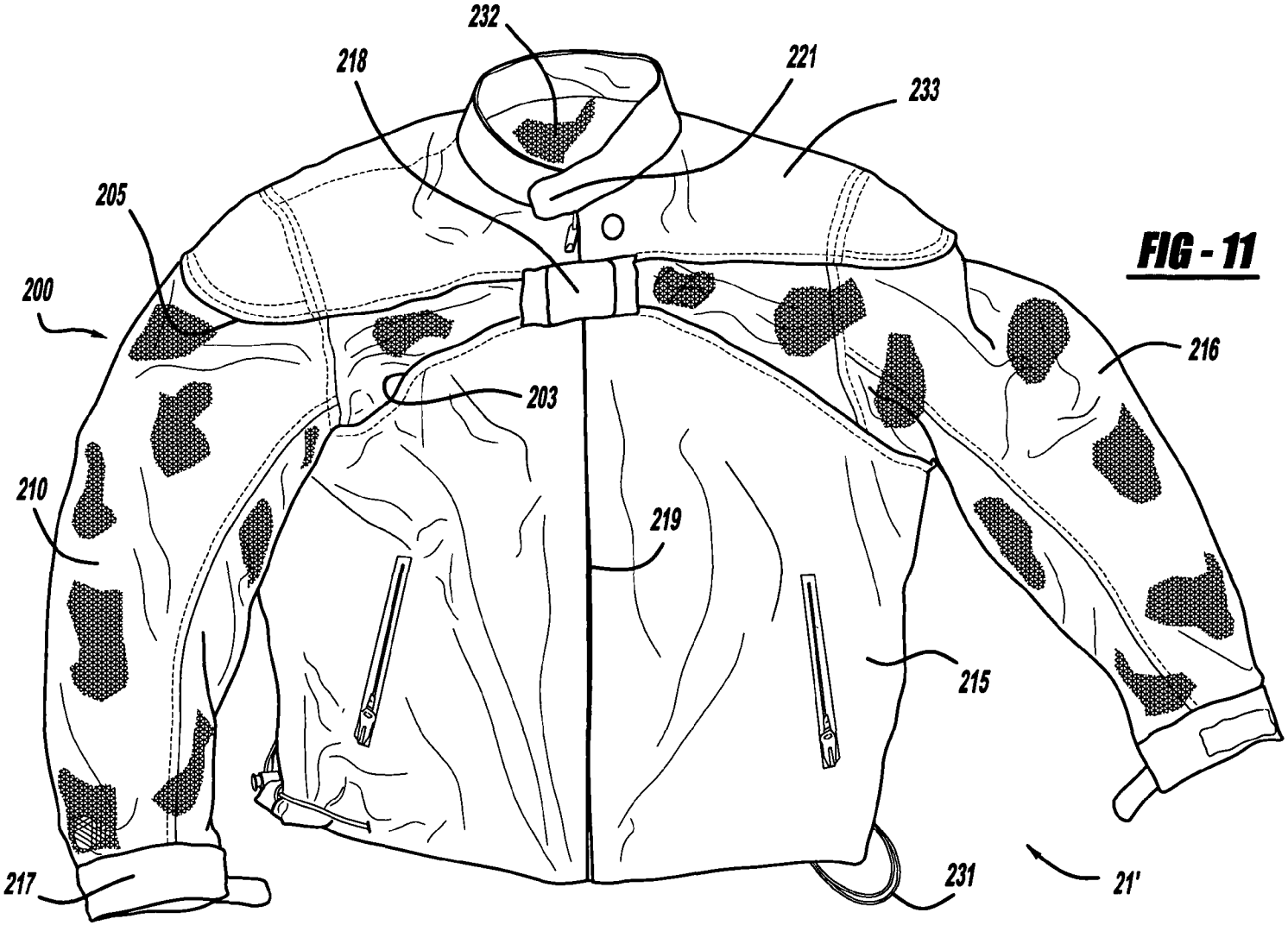
FIG. 11 is front elevational view showing the second preferred embodiment garment, with the shell fully removed.
Figure 12:
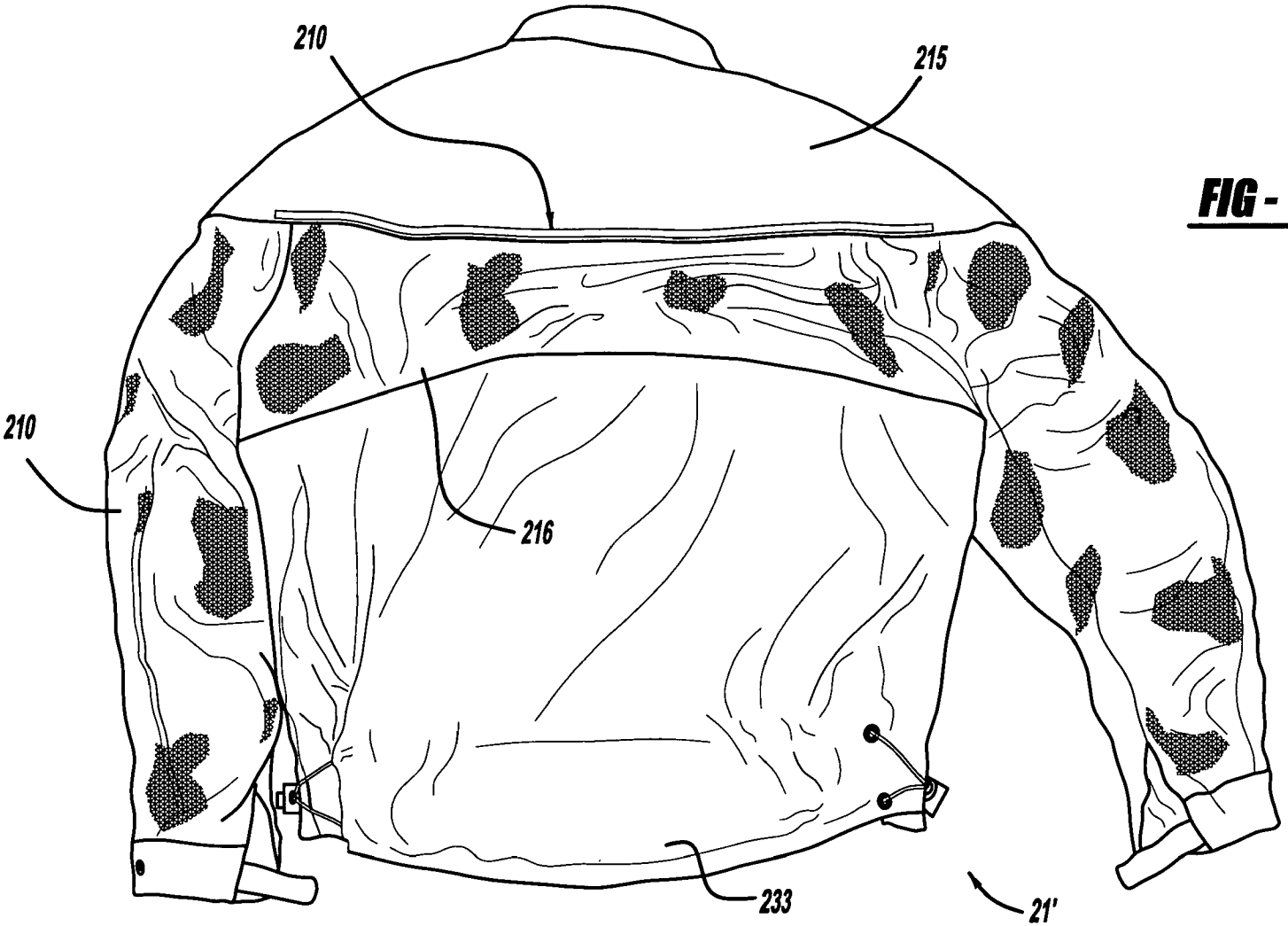
FIG. 12 is rear elevational view showing the second preferred embodiment garment, with the shell fully removed.

Referring to FIG. 4, an optional pant strap and snap attachment 99 is attached to an inside surface of inner liner 29 at a back of the torso segment adjacent the waistband. Furthermore, a hook-and-loop, adjustable strap is attached to air permeable mesh material 33 of each sleeve adjacent its sleeve opening to allow adjustability. A hidden snap attachment provides fastening of the sleeve ends between the shell and body.

Outer mesh material 33 is preferably a piece dyed, polyester mesh tricot fabric having perforated holes of approximately two square or diametral millimeters. The outer mesh material has a weight of about 480 gr/yd, and a yarn of about 250 D, S/D, R/W; the mesh can stretch approximately 20%. Inner liner 29 is preferably a lighter weight, polyester knitted fabric having perforated holes of approximately two or three square or diametral millimeters. The much denser wind resistant and ultraviolet light blocking material 31 and 44 located on body 25 and shell 27, respectively, are preferably a 600 denier polyester fabric having a polyurethane inside coating, but may alternately be Taslen or Cordura® brand nylon fabric.

Figure 3A:
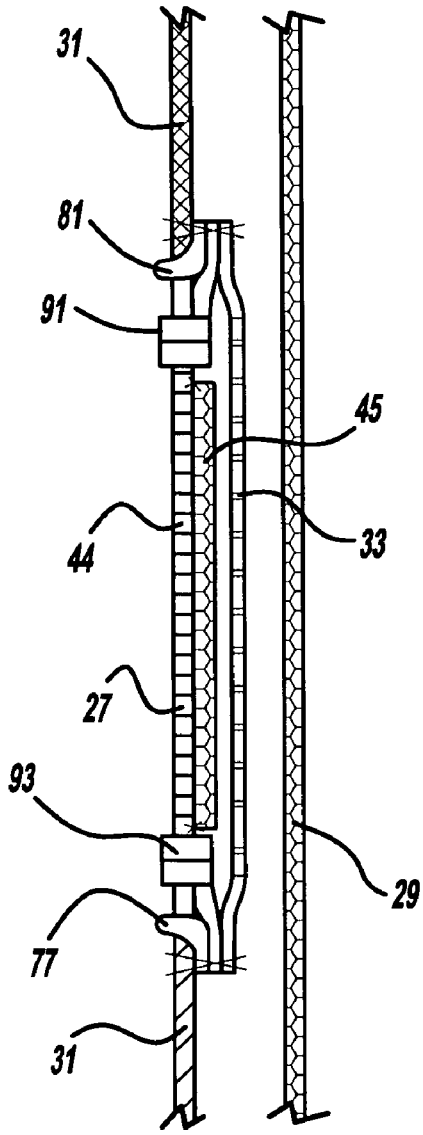
FIG. 3*a* is a cross-sectional view, taken along line 3*a*-3*a* of FIG. 3, showing the first preferred embodiment garment.
Figure 3:
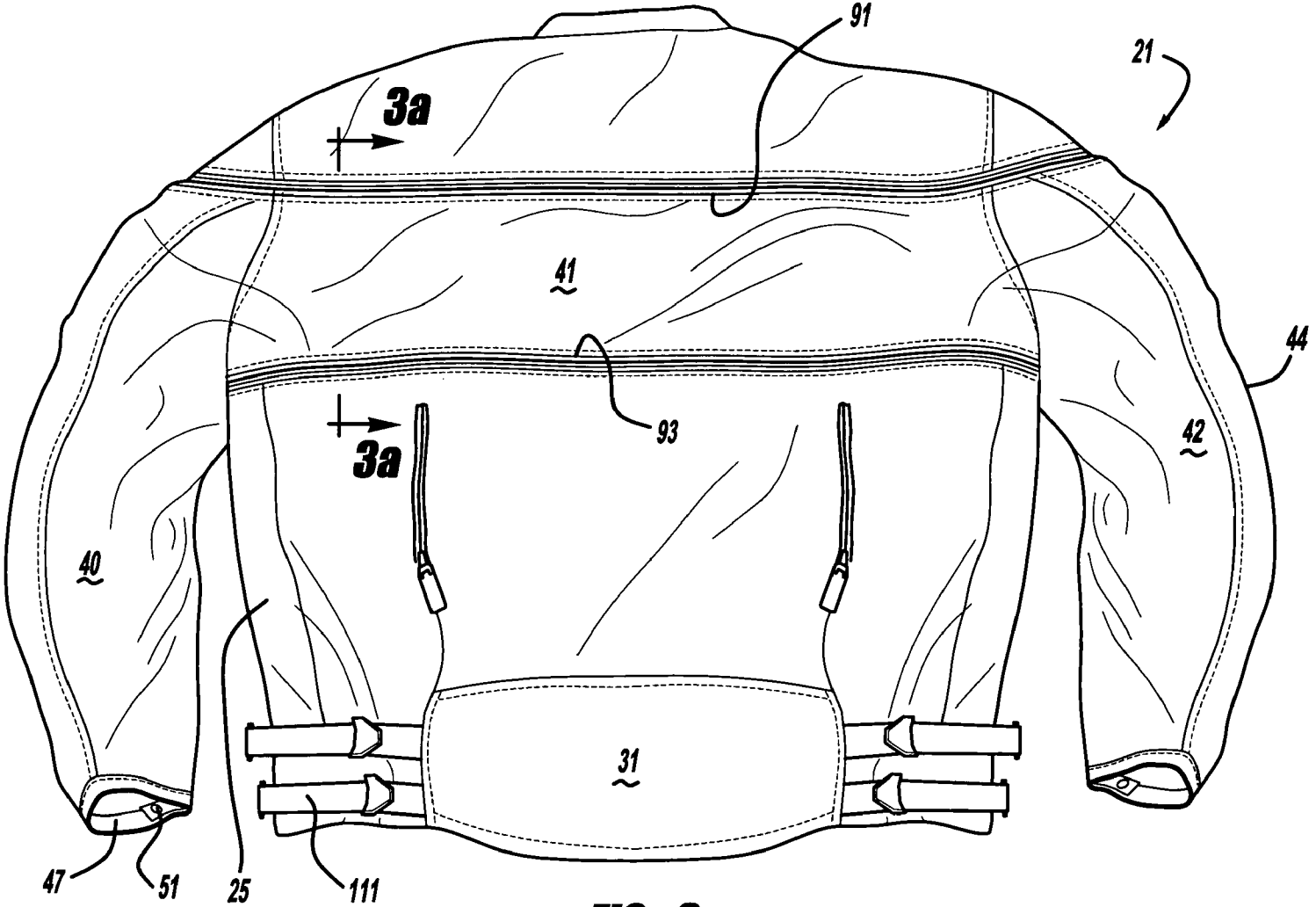
FIG. 3 is a rear elevational view showing the first preferred embodiment garment, with the shell attached to the body.

Shown in FIGS. 3 and 4 is waistband 41 including a pair of looped straps 111 on each side which adjustably change the snugness of the waist area by hook-and-loop fasteners. Zippered pockets 113 are also disposed on each front side in the wind resistant material of the lower torso body 15.

Not only does the removable shell provide ventilating benefits to the user's arms, chest and upper back, but it also achieves noteworthy aesthetic appeal. For example, outer mesh 33 is preferably a bright orange color, while wind resistant material 31 and 44 on the shell and body is black. Thus, a striking visual color contrast is observed when the shell is removed. Alternately, outer mesh 33 may be a reflective or luminescent color or material for safety, or may have an artistic design thereon which can be optionally displayed or hidden by the user.

A second preferred embodiment of the present invention garment 21' is shown in FIGS. 9-12. This jacket is similar to that of the prior embodiment except for the following aesthetic differences. The primary vent 200 has a zipper and cut-line interface 201, at the bottom, front of a shell 203, with a generally diagonal orientation while the zipper and cut-line interface 205 at the top of shell 203 is more rounded at the exterior of each shoulder. Similarly, the zipper and cut-line interface 207 at the bottom, rear of shell 203 has a curved shape, rising in the center, as compared to the more laterally linear lines of the first embodiment. Furthermore, no secondary zipper vents on the sleeves and back torso are employed with this second embodiment (although it may alternately be provided).

Another difference is that below the wind resistant shoulder-to-air permeable sleeve interface, sleeves 210 of a body 215 are almost entirely air permeable mesh 216 except for cuffs 217 and seams. This embodiment also has enlarged and more pronounced cuffs 217 adjacent the open sleeve ends of shell 203 and underlying mesh 216 of body 215. A central storm flap 218 attached to body 215 operably covers across the entire intersection of the upper and lower shell zippers and a central zipper system 219, but only in this localized chest area. Additionally, an extended flap 221 extends from a collar 223 across central zipper system 219 and is secured by a snap or hook-and-loop attachment. A pair of elasticized pull cords 231, externally held together at each end by a compressible polymeric toggle and fabric tab, enter eyelets on each side of shell 203 and extend between the outer fabric layer and the inner fabric or liner layer 232. These cords are used to tighten the lateral periphery of the shell in use to minimize air entry. In this configuration, mesh 216 and an outer fabric of shell 203 are a bright red color while a wind resistant outer material 233 of body 215 is black.

While various aspects of the present invention have been disclosed, it should be appreciated that variations may be made without departing from the scope of the present invention. For example, the shell may include a thermally insulative layer sewn or temporarily attached to the inside thereof. Moreover, alternate snap, hook-and-loop, interlocking barb, button, zipper and other disengagable fasteners can be employed instead of those disclosed, although some of the wind deterrent benefits of the present invention may not be realized. Shirts and other such garments may readily employ certain aspects of the present invention, although some of the advantages of the present invention may not be achieved. The preferred mesh ventilation material may solely be used on the sleeves, the torso, and/or localized portions thereof as long as an outer removable covering is provided, although again, some of the advantages of the present invention may not be fulfilled. Additional PVC or other waterproof coatings may be provided on any of the fabric layers to provide water resistance or waterproofing. It is also envisioned that the outer mesh material employed can be perforated with slits or cuts as long as ventilation is achieved. A leather shell and/or body can be used instead of a textile one, however, various advantages of the present invention may not be utilized. The present invention may alternately be used by bicycle riders, waist bags can be provided at the rear of the body for receiving the removed shell, and waterproof zippers can be provided in place of those disclosed herein. Furthermore, various materials, dimensions and colors have been disclosed in an exemplary fashion, but other materials, dimensions and colors may of course be employed, although some of the advantages of the present invention may not be realized. It is intended by the following claims to cover these and any other departures from the disclosed embodiments which fall within the true spirit of the invention.

The invention claimed is:

1. A garment comprising:

an air permeable material extending at least a majority of a lateral distance between opposite garment armpit areas;

an upper zipper attachment system to secure a top portion of a wind resistant shell to cover the air permeable material, the upper zipper attachment system extending horizontally across a top chest portion of the garment, around exterior portions of garment sleeve areas, and horizontally across a first upper torso back portion of the garment; and a lower zipper attachment system to secure a bottom portion of the wind resistant shell to cover the air permeable material, the lower zipper attachment system extending horizontally across a bottom chest portion of the garment, around the armpit areas, and horizontally across a second upper torso back portion of the garment.

2. The garment of claim 1 further comprising the wind resistant shell removable from the air permeable material that is underlying.

3. The garment of claim 2 wherein the wind resistant shell further comprises a right chest segment, a right sleeve segment, the first and second upper torso back portions, a left sleeve segment and a left chest segment, all being attached together and removable from the underlying air permeable material as a single piece.

4. The garment of claim 1 further comprising an air permeable sleeve section permanently secured to the laterally extending air permeable material.

5. The garment of claim 1 further comprising:

a first wind resistant material permanently attached to a lower edge of the air permeable material to cover a lower torso area; and a second wind resistant material permanently attached to an upper edge of the air permeable material to cover shoulder areas.

6. The garment of claim 1 wherein the air permeable material is a mesh textile material.

7. The garment of claim 1 wherein the garment is a motorcycle jacket further comprising body armor internally attached thereto.

8. A garment comprising:

a jacket body comprising an air permeable material extending at least a majority of a lateral distance between opposite garment armpit areas, the air permeable material having a longitudinal dimension from a first zipper system to a second zipper system less than an elongated lateral dimension that extends from the opposing garment armpit areas, the air permeable material including a mesh material located on a right chest area, a right sleeve, a back area, a left sleeve and a left chest area; and a wind resistant shell removably attached to the jacket body and covering the mesh material at the areas with a single piece, comprising a right chest segment, a substantially cylindrical right sleeve segment that completely covers an outer circumference of the right sleeve, a back segment, a substantially cylindrical left sleeve segment that completely covers an outer circumference of the left sleeve, and a left chest segment.

9. The garment of claim 8 further comprising at least an upper zipper removably coupling an upper portion of the wind resistant shell to the jacket body.

10. The garment of claim 8 wherein the mesh material is located on a torso area above a theoretical line substantially between the armpits areas.

11. The garment of claim 8 wherein the mesh material continuously extends between the armpit areas and is separated by a central and substantially vertical attachment system when a garment user is in a standing orientation.

12. The garment of claim 8 wherein the garment is a motorcycle jacket further comprising body armor internally attached to the jacket body.

* * * * *